US006896750B2

(12) United States Patent
Wolter

(10) Patent No.: US 6,896,750 B2
(45) Date of Patent: May 24, 2005

(54) TANTALUM MODIFIED AMORPHOUS ALLOY

(75) Inventor: George W. Wolter, Whitehall, MI (US)

(73) Assignee: Howmet Corporation, Cleveland, OH (US)

( * ) Notice: Subject to any disclaimer, the term of this patent is extended or adjusted under 35 U.S.C. 154(b) by 0 days.

(21) Appl. No.: 10/286,408

(22) Filed: Oct. 31, 2002

(65) Prior Publication Data

US 2004/0084114 A1 May 6, 2004

(51) Int. Cl.[7] ..... C22C 45/10

(52) U.S. Cl. ..... 148/561; 148/403; 148/421; 420/423

(58) Field of Search ..... 148/403, 423, 148/561; 420/423

(56) References Cited

U.S. PATENT DOCUMENTS

| | | | | |
|---|---|---|---|---|
| 4,113,478 A | | 9/1978 | Tanner et al. | 75/177 |
| 4,126,449 A | | 11/1978 | Tanner et al. | 75/164 |
| 4,135,924 A | | 1/1979 | Tanner et al. | 75/159 |
| 4,148,669 A | | 4/1979 | Tanner et al. | 148/3 |
| 4,171,992 A | | 10/1979 | Tanner et al. | 148/3 |
| 4,623,387 A | | 11/1986 | Masumoto et al. | 420/41 |
| 5,032,196 A | | 7/1991 | Masumoto et al. | 148/403 |
| 5,368,659 A | | 11/1994 | Peker et al. | 148/403 |
| 5,454,884 A | | 10/1995 | Hashimoto et al. | 148/403 |
| 5,735,975 A | | 4/1998 | Lin et al. | 148/403 |
| 5,772,803 A | | 6/1998 | Peker et al. | 148/561 |
| 5,797,443 A | * | 8/1998 | Lin et al. | 164/4.1 |
| 5,980,652 A | * | 11/1999 | Inoue et al. | 148/403 |
| 6,231,697 B1 | | 5/2001 | Inoue et al. | 148/561 |
| 6,682,611 B2 | * | 1/2004 | Zhang et al. | 148/561 |
| 2002/0036034 A1 | | 3/2002 | Xing et al. | 148/561 |

FOREIGN PATENT DOCUMENTS

| | | | |
|---|---|---|---|
| DE | 10237992 A1 | * | 3/2003 |
| EP | 0 905 268 A1 | | 3/1999 |
| JP | 355138049 A | | 10/1980 |
| JP | 03158446 A | | 7/1991 |
| JP | 08253847 A | | 10/1996 |
| JP | 409316613 A | | 12/1997 |
| JP | 2000178700 A | | 6/2000 |
| WO | 03/040422 | | 5/2003 |

* cited by examiner

*Primary Examiner*—George Wyszomierski
(74) *Attorney, Agent, or Firm*—Gary P. Topolosky; Eckert Seamans Cherin & Mellott, LLC

(57) ABSTRACT

An amorphous alloy having a composition represented by the formula $(Zr,Hf)_a(Al,Zn)_bTi_e,Nb_f,Ta_gY_h(Cu_xFe_y(Ni,Co)_z)_d$ wherein a ranges from 45 to 65 atomic %, b ranges from 5 to 15 atomic %, e and f each ranges from 0 to 4.5 atomic %, g ranges from greater than 0 to 2 atomic %, h ranges from 0 to 0.5 atomic %, and the balance is d and incidental impurities and wherein e+f+g ranges from 3.5 to 7.5 atomic %, d times y is less than 10 atomic %, and x/z ranges from 0.5 to 2.

22 Claims, 2 Drawing Sheets

TANTALUM MODIFIED AMORPHOUS ALLOY

FIELD OF THE INVENTION

The present invention relates to amorphous metallic alloys and their manufacture.

BACKGROUND OF THE INVENTION

Amorphous metallic alloys are known which have essentially no crystalline microstructure when rapidly cooled to a temperature below the alloy glass transition temperature before appreciable grain nucleation and growth occurs. For example, U.S. Pat. No. 5,735,975 discloses amorphous metallic alloys represented by the alloy composition, $(Zr,Hf)_a(Al,Zn)_b(Ti,Nb)_c(Cu_x,Fe_y(Ni,Co)_z)_d$ that can be rapidly solidified to produce an amorphous body. The patent indicates that an appreciable amount of oxygen may dissolve in the metallic glass without significantly shifting the crystallization curve. However, the amorphous metallic alloys described in above U.S. Pat. No. 5,735,975 typically are made from pure, laboratory grade components and have a low bulk oxygen impurity content of less than about 200 ppm by weight (or 800 ppm oxygen on an atomic basis).

SUMMARY OF THE INVENTION

An embodiment of the present invention involves certain Zr-based amorphous alloys that can be made from commercially available raw materials and that can be conventionally cast to a substantially greater thickness while retaining a bulk amorphous microstructure. The invention involves providing an intentional addition of tantalum (Ta) in the Zr-based amorphous alloys that exceeds zero yet does not exceed about 2.0 atomic % based on the alloy composition, and preferably is in the range of about 1 to about 2 atomic % Ta based on the alloy composition. An alloy addition of Y also optionally can be made in the amount of greater than 0 to about 0.4 atomic % Y. The Ta and Y addition to certain Zr-based amorphous alloys having a relatively high bulk oxygen impurity concentration after the alloy is melted and cast increases alloy resistance to crystallization such that bulk amorphous cast products with greater dimensions can be made using commercially available raw materials and conventional casting processes.

In an embodiment of the invention, a Zr based amorphous alloy is represented by the atomic formula:

$$(Zr,Hf)_a(Al,Zn)_bTi_eNb_fTa_gY_h(Cu_xFe_y(Ni,Co)_z)_d$$

wherein a (Zr and/or Hf) ranges from 45 to 65 atomic %, b (Al and/or Zn) ranges from 5 to 15 atomic %, e and f each ranges from 0 to 4.5 atomic %, g ranges from greater than 0 to 2 atomic %, h ranges from 0 to 0.5 atomic %, and the balance is d and incidental impurities and wherein e+f+g ranges from 3.5 to 7.5 atomic %, d times y is less than 10 atomic %, and x/z ranges from 0.5 to 2. In the alloy represented by the above atomic formula, only one or both of Ti or Nb can be present. When both Ti and Nb are present in the alloy, the sum of e+f preferably is less than about 4 atomic %.

Another embodiment of the invention provides a Zr-based amorphous alloy having an alloy composition, in atomic %, consisting essentially of about 54 to about 57% Zr, 0 to about 4% Ti, 0 to about 4% Nb, greater than 0 to about 2% Ta, about 8 to about 12% Al, about 14 to about 18% Cu, and about 12 to about 15% Ni, and up to about 0.5% Y. About 0.1 to about 0.4 atomic % Y preferably is present in the alloy with an alloy bulk oxygen impurity concentration of, at least about 1000 ppm on an atomic basis. Such an amorphous alloy can be conventionally vacuum melted and die cast to form a bulk amorphous cast plate having a cross-sectional thickness that is twice that achievable without Y present in the alloy, despite having relatively high bulk oxygen concentration after melting and casting.

The above and other advantages of the present invention will become more readily apparent from the following drawings taken in conjunction with the following detailed description.

DESCRIPTION OF THE DRAWINGS

FIGS. 2A, 2B, 2C, 2D and 3E are x-ray diffraction patterns of plate specimens 85, 88, 95, 98, and 102 vacuum die cast to the same plate thicknesses.

DESCRIPTION OF THE INVENTION

Figure 1:
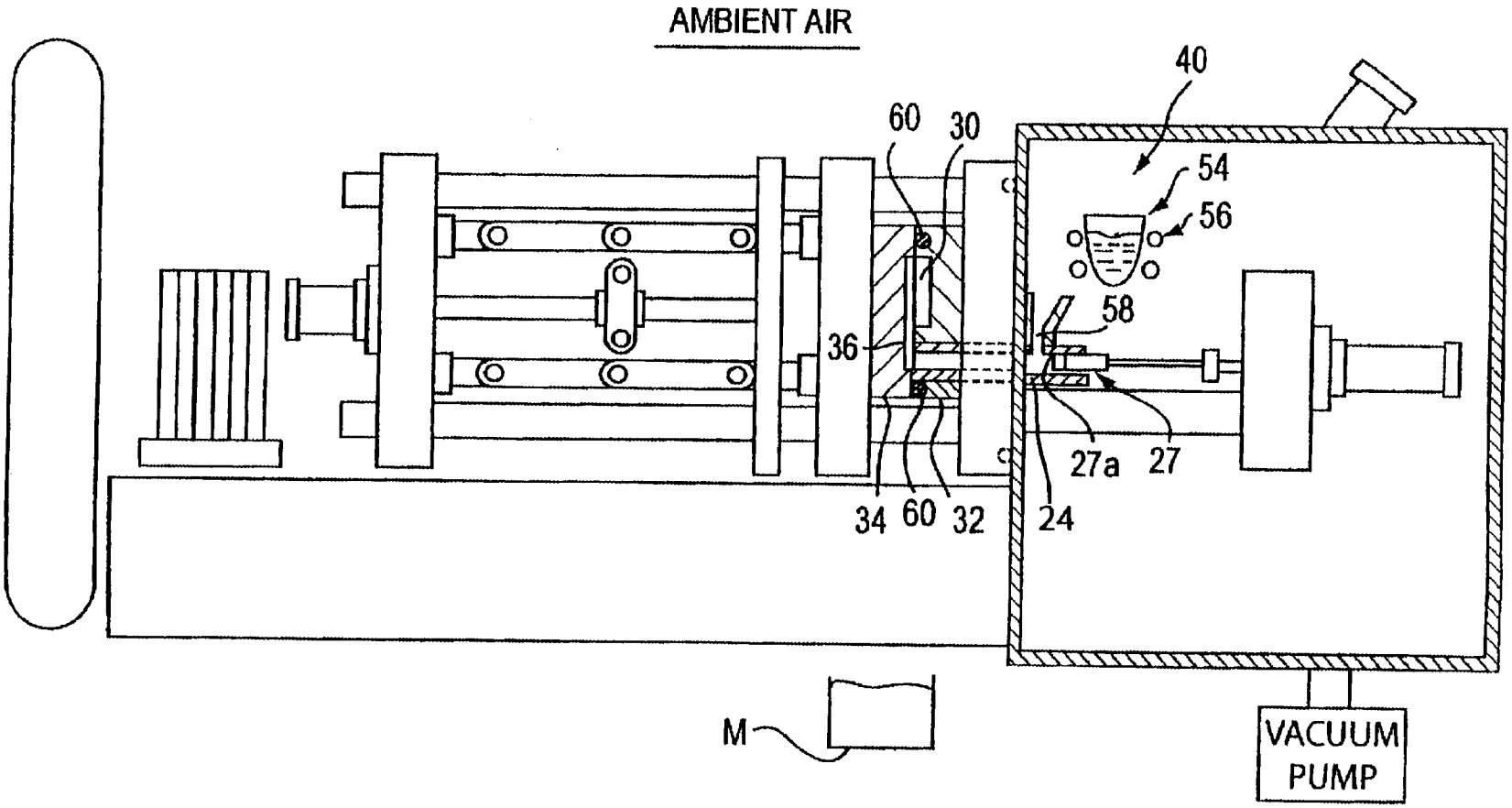
FIG. 1 is schematic view of a vacuum die casting machine used to cast plate test specimens.

The present invention involves modifying the composition of a Zr based amorphous alloy of the type described in U.S. Pat. No. 5,735,975, the teachings of which are incorporated herein by reference. The patented Zr based alloy consists essentially of about 45 to about 65 atomic % of at least one of Zr and Hf, about 4 to about 7.5 atomic % of least one of Ti and Nb, and about 5 to about 15 atomic % of at least one of Al and Zn. The balance of the alloy composition comprises Cu, Co, Ni and up to about 10 atomic % Fe. The Hf is essentailly interchangeable with Zr, while Al is interchangeable with Zn.

The composition of the amorphous alloy is modified pursuant to an embodiment of the present invention to provide an intentional addition of tantalum (Ta) to the alloy composition. Pursuant to another embodiment of the present invention, a Ta-modified alloy is made using commercially available raw materials that, in combination with subsequent conventional vacuum melting and casting, can result in a relatively high bulk oxygen impurity concentration in the alloy in the range of about 300 to about 600 ppm by weight (about 1000 to about 2000 ppm oxygen on atomic basis) after the alloy is melted and cast. For purposes of illustration and not limitation, such raw materials typically include the following commercially available alloy charge components which are melted to form the alloy: Zr sponge having 100 to 300 ppm O impurity, Ti sponge having 600 ppm O impurity, Ni shot having 50 ppm O impurity, and a Ni—Nb master alloy having 300 to 500 ppm O impurity (ppm's by weight). The Ta addition is made using commercially available Ta whose oxygen content was not determined. The bulk oxygen impurity concentration is the oxygen concentration of the melted and cast alloy resulting from the raw materials that are melted together, from the melting process, and from the casting process to make a cast body or product. For example, in addition to oxygen impurities introduced into the alloy from the raw materials, additional oxygen impurities can be introduced into the alloy from residual oxygen present in the melting chamber and/or in a die or mold cavity in which the molten alloy is cast to form a cast body or product, and/or by reaction of the molten alloy with a ceramic material (metal oxide), such as zirconia, forming a crucible in which the alloy is melted and/or a mold in which the molten alloy is cast.

For purposes of illustration and not limitation, the above charge components can be melted in an induction melting crucible that comprises graphite, zirconia, and/or other suitable refractory material, or by a cold crucible melting method such as induction skull melting, and present in appropriate proportions to yield the desired alloy composition.

For purposes of illustration and not limitation, the charge components can be first melted in a graphite or zirconia crucible at a temperature in the range of 2700 to 3000 degrees F. under a gas (e.g. inert gas) partial pressure to reduce aluminum volatilization, cooled to a lower temperature where a vacuum of about 2 to about 20 microns, such as 2 to 5 microns, is established, and then remelted at 1800 to 2100 degrees F. under the vacuum followed by casting. The invention is not limited to any particular melting technique and can be practiced using other melting techniques such as cold wall induction melting (in a water-cooled copper crucible), vacuum arc remelting, electrical resistance melting, and others in one or multiple melting steps.

An addition of yttrium (Y) optionally is made to the alloy composition when alloy bulk oxygen content is in the range of about 300 to about 600 ppm by weight (about 1000 to about 2000 ppm oxygen on atomic basis) after the alloy is melted and cast. The Y addition is greater than zero yet does not exceed about 0.5 atomic % based on the alloy composition, and preferably is in the range of about 0.2 to about 0.4 atomic % Y based on the alloy composition. The Y addition typically is made by including with the above commercially available raw material charge components, a Y-bearing charge component comprising a Y-bearing master alloy, such as a commercially available Al—Y master alloy, Ni—Y master alloy or others, and/or elemental Y, although the invention is not limited in the way in which Y can be introduced.

The Ta addition and optional Y addition to the above amorphous alloy having a relatively high bulk oxygen impurity concentration (about 300 to about 600 ppm by weight) increase alloy resistance to crystallization such that bulk amorphous cast products with greater dimensions can be made by conventional vacuum casting processes. Such conventional casting processes will provide cooling rates of the molten alloy typically of $10^2$ to $10^3$ degrees C. per second and lower. Vacuum die casting is an illustrative conventional casting process for use in practicing the invention as described below, although the invention can be practiced using other conventional casting processes including, but not limited to, vacuum gravity casting, and is not limited in this regard.

Amorphous cast products made pursuant to the invention typically will have at least 50% by volume of the amorphous or glassy phase. This is effectively a microscopic and/or macroscopic mixture of amorphous and crystalline phases in the cast product or body. Preferably, bulk amorphous cast products or bodies made pursuant to the invention typically have between about 80% and about 90% by volume of the amorphous or glassy phase, and even more preferably about 95% by volume or more of the amorphous or glassy phase.

One embodiment of the present invention provides a Zr based amorphous alloy represented by the atomic formula:

$$(Zr,Hf)_a(Al,Zn)_bTi_eNb_fTa_gY_h(Cu_xFe_y(Ni,Co)_z)_d$$

wherein a (Zr and/or Hf) ranges from 45 to 65 atomic %, b (Al and/or Zn) ranges from 5 to 15 atomic %, e and f each ranges from 0 to 4.5 atomic %, g ranges from greater than 0 to 2 atomic %, h ranges from 0 to 0.5 atomic %, and the balance is d and incidental impurities and wherein e+f+g ranges from 3.5 to 7.5 atomic %, d times y is less than 10 atomic %, and x/z ranges from 0.5 to 2. In the alloy represented by the above atomic formula, only one or both of Ti or Nb can be present. When both Ti and Nb are present in the alloy, the sum of e+f preferably is less than about 4 atomic %.

Another embodiment of the present invention provides a Zr based amorphous alloy is provided having an alloy composition, in atomic %, consisting essentially of about 54 to about 57% Zr, 0 to about 4% Ti, 0 to about 4% Nb, greater than 0 to about 2% Ta, about 8 to about 12% Al, about 14 to about 18% Cu, and about 12 to about 15% Ni, and up to 0.5% Y. About 0.1 to about 0.4 atomic % Y preferably is present in the alloy with an alloy bulk oxygen impurity concentration of at least about 1000 ppm on an atomic basis. When both Ti and Nb are present, their collective concentration preferably is less than about 4 atomic % of the alloy. The Ta concentration preferably is about 1 to about 2 atomic % of the alloy composition. Such a Zr based amorphous alloy can be conventionally vacuum die cast to form a bulk amorphous cast plate having a cross-sectional thickness, which typically is at least twice the thickness achievable without Ta and Y being present in the alloy composition.

The following example is offered to further illustrate but not limit the invention.

Zr based amorphous test alloys were made having compositions, in atomic %, shown in the Table below. The test alloys were made using the above-described commercially available raw materials. The test alloys had a relatively high bulk oxygen impurity concentration in the range of 300 to 600 ppm by weight (1000 to 2000 ppm on atomic basis) for all alloys tested after die casting.

TABLE

| | Zr | Cu | Ni | Al | Ti | Nb | Ta | Y | Integrity | XRD |
|---|---|---|---|---|---|---|---|---|---|---|
| Plate 85 | 55 | 16.5 | 13.5 | 10 | 2 | 3 | 1 | 0.4 | Intact | amorphous |
| Plate 88 | 55 | 16.5 | 13.5 | 10 | 1.5 | 2 | 1 | 0.4 | Intact | amorphous |
| Plate 92 | 55 | 16.5 | 13.5 | 10 | 1.5 | 1.5 | 1.5 | 0.4 | Intact | amorphous |
| Plate 94 | 55 | 16.5 | 13.5 | 10 | 1.5 | 1 | 2 | 0.4 | Intact | amorphous |
| Plate 95 | 55 | 16.5 | 13.5 | 10 | 2 | 1 | 1.5 | 0.4 | Intact | mostly amorphous |
| Plate 96 | 55 | 16.5 | 13.5 | 10 | 2.5 | 0 | 2.5 | 0.4 | cracked | amorphous |

TABLE-continued

| | Zr | Cu | Ni | Al | Ti | Nb | Ta | Y | Integrity | XRD |
|---|---|---|---|---|---|---|---|---|---|---|
| Plate 97 | 55 | 16.5 | 13.5 | 10 | 0 | 2.5 | 2.5 | 0.4 | cracked | mostly amorphous |
| Plate 98 | 55 | 16.5 | 13.5 | 10 | 0 | 0 | 4.5 | 0.4 | cracked | mostly amorphous |
| Plate 99 | 55 | 16.5 | 13.5 | 10 | 1.5 | 1.5 | 1.5 | 0.2 | Intact | amorphous |
| Plate 100 | 55 | 16.5 | 13.5 | 10 | 1.5 | 1.5 | 1.5 | 0.4 | cracked | amorphous |
| Plate 101 | 55 | 16.5 | 13.5 | 10 | 1.5 | 1.5 | 1.5 | 0.1 | Intact | amorphous |
| Plate 102 | 55 | 16.5 | 13.5 | 10 | 1.5 | 1.5 | 1.5 | 0 | cracked | partly crystalline |

For the test alloys, the above raw materials were first melted in a graphite crucible 54 using induction coil 56 in a vacuum melting chamber 40 of a vacuum die casting machine of the type shown schematically in FIG. 1 and described in Colvin U.S. Pat. No. 6,070,643, the teachings of which are incorporated herein by reference. The raw materials were melted at a temperature in the range of 2700 to 3000 degrees F. under an argon partial pressure of 200 torr, then cooled to about 1500 degrees F. where a vacuum of 5 microns was established in chamber 40, and then remelted at 1800 to 2100 degrees F. under the vacuum followed by die casting. Each melted test alloy was poured from crucible 54 through opening 58 into a shot sleeve 24 and then immediately injected by plunger 27 into a die cavity 30. Die cavity 30 was defined between first and second dies 32, 34 and communicated to the shot sleeve via entrance gate or passage 36. A seal 60 was present between dies 32, 34. The dies 32, 34 comprised steel and were disposed in ambient air without any internal die cooling. The die cavity 30 was evacuated to 5 microns through the shot sleeve 24 and was configured to produce rectangular plates (5 inches width by 14 inches length) with a different plate thickness being produced in different casting trials. The plunger speed was in the range of 20–60 feet/second. The plunger tip 27*a* comprised a beryllium copper alloy. The alloy casting was held in the die cavity 30 for 10 seconds and then ejected into ambient air and quenched in water in container M.

Figure 2A:
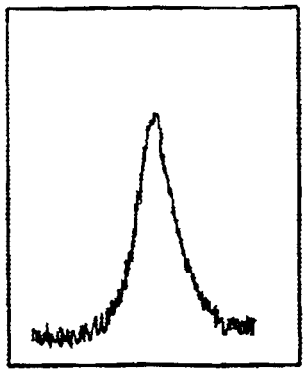
Figure 2D:
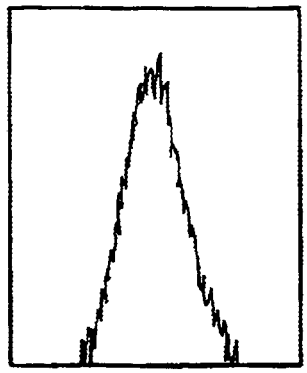
Figure 2B:
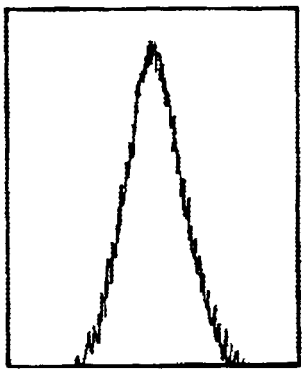

The vacuum die casting trials revealed that plate specimens 85, 88, 92, 94 and 95 made of the test alloys set forth could be vacuum die cast with a bulk amorphous microstructure to a plate thickness up to 0.180 inch without plate cracking as represented by designation "intact" in the Table. Plate specimens 85, 88, 92, 94 and 95 each had an as-cast plate thickness of 0.180 inch. FIGS. 2A and 2B show diffraction patterns for plate specimens 85 and 88.

Figure 2E:
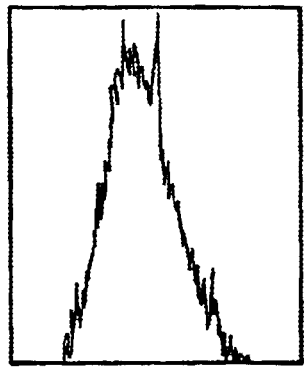
Figure 2C:
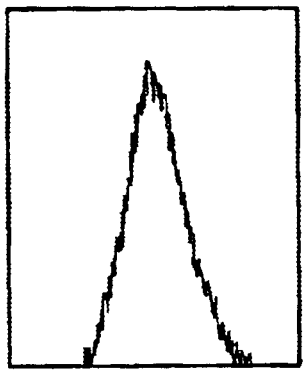

FIG. 2C shows a diffraction pattern for plate specimen 95 which was "intact" and mostly amorphous at 0.180 inch plate thickness.

When Ta concentration was increased to 2.5 atomic %, the corresponding plates 96 and 97 exhibited amorphous or mostly amorphous microstructure and cracking despite the concentration of Y being maintained at 0.4 atomic %. Plate specimens 96 and 97 each had as-cast plate thickness of 0.180 inch. Similar results were observed when Ta concentration was increased to 4.5 atomic % to replace all of the Ti and Nb, wherein the plate 98 exhibited mostly amorphous microstructure and cracking despite the concentration of Y being maintained at 0.4 atomic %. Plate specimen 98 had an as-cast plate thickness of 0.180 inch. FIG. 2D is an x-ray diffraction pattern of plate 98.

When Y concentration was reduced to 0 atomic %, the corresponding plate 102 exhibited a partly crystalline microstructure and cracking. Plate specimen 102 had an as-cast plate thickness of 0.180 inch. FIG. 2E is an x-ray diffraction pattern of plate 102.

Plate 100 was cracked even though the composition suggested that it should not have cracked. It is suspected that the plate cracked as a result of an anomaly (such as being stuck on the die), rather than an intrinsic cause. The Table shows that the alloys of the invention having Ta and Y concentrations controlled as specified above are formable (die castable) and are primarily amorphous as die cast. The Table shows the alloy composition including 1.5% Nb-1.5% Ti–1.5% Ta was die castable in an amorphous state over a wide range of Y concentrations.

Although the invention has been described with respect to certain embodiments, those skilled in the art will appreciate that modifications, and the like can be made without departing from the scope of the invention as set forth in the appended claims.

I claim:

1. An amorphous alloy represented by the atomic formula:

$$(Zr,Hf)_a(Al,Zn)_bTi_e,Nb_f,Ta_gY_h(Cu_xFe_y(Ni,Co)_z)_d$$

wherein a ranges from 45 to 65 atomic %, b ranges from 5 to 15 atomic %, e and f each ranges from greater than 0 to 4.5 atomic %, g ranges from greater than 0 to 2 atomic %, h ranges from 0 to 0.5 atomic %, and the balance is d and incidental impurities wherein the Ti, Nb, and Ta comprise intentional alloying elements in the alloy and wherein e+f+g ranges from 3.5 to 7.5 atomic %, d times y is less than 10 atomic %, and x/z ranges from 0.5 to 2.

2. The alloy of claim 1 wherein g ranges from 1 to 2 atomic %.

3. The alloy of claim 1 wherein h ranges from 0.1 to 0.4 atomic %.

4. The alloy of claim 1 wherein Ti and Nb are both present and e+f is less than about 4 atomic %.

5. A bulk amorphous cast body comprising the alloy of claim 1.

6. The cast body of claim 5 which is die cast.

7. An amorphous alloy consisting essentially of, in atomic %, about 54 to about 57% Zr, greater than 0 to about 4% Ti, greater than 0 to about 4% Nb, greater than 0 to about 2% Ta, about 8 to about 12% Al, about 14 to about 18% Cu, and about 12 to about 15% Ni, and 0 to about 0.5% Y wherein the Ti, Nb, and Ta comprise intentional alloying elements in the alloy.

8. The alloy of claim 7 wherein Ta is present in an amount from about 1 to about 2 atomic %.

9. The alloy of claim 7 having a Y content of 0.1 to 0.4 atomic % Y.

10. The alloy of claim 7 having a bulk oxygen impurity concentration of at least about 1000 ppm on atomic basis and a Y content of 0.1 to 0.4 atomic % Y.

11. A bulk amorphous cast body comprising the alloy of claim 7.

12. The cast body of claim 11 which is die cast.

13. A method of making a bulk amorphous alloy casting, comprising providing a molten alloy with a composition represented by the atomic formula:

$$(Zr,Hf)_a(Al,Zn)_bTi_e,Nb_f,Ta_gY_h(Cu_xFe_y(Ni,Co)_z)_d$$

wherein a ranges from 45 to 65 atomic %, b ranges from 5 to 15 atomic %, e and f each ranges from greater than 0 to 4.5 atomic %, g ranges from greater than 0 to 2 atomic %, h ranges from 0 to 0.5 atomic %, and the balance is d and incidental impurities wherein the Ti, Nb, and Ta comprise intentional alloying elements in the alloy and wherein e+f+g ranges from 3.5 to 7.5 atomic %, d times y is less than 10 atomic %, and x/z ranges from 0.5 to 2, and and casting said alloy in a cavity to produce a bulk amorphous alloy casting.

14. The method of claim 13 wherein g is 1 to 2.

15. The method of claim 13 wherein h is 0.1 to 0.4.

16. The method of claim 13 wherein Ti and Nb are both present and e+f is less than about 4 atomic %.

17. A method of making a bulk amorphous alloy casting, comprising providing a molten alloy with a composition consisting essentially of about 54 to about 57% Zr, greater than 0 to about 4% Ti, greater than 0 to about 4% Nb, greater than 0 to about 2% Ta, about 8 to about 12% Al, about 14 to about 18% Cu, and about 12 to about 15% Ni, and 0 to about 0.5% Y, and incidental impurities, wherein the Ti, Nb, and Ta comprise intentional alloying elements in the alloy, and and casting said alloy in a cavity to produce a bulk amorphous alloy casting.

18. The method of claim 17 wherein said alloy has a Y content of about 0.1 to about 0.4 atomic % Y.

19. The method of claim 17 wherein said alloy has a bulk oxygen impurity concentration of at least about 1000 ppm on an atomic basis after said casting and a Y content of about 0.1 to about 0.4 atomic % Y.

20. The method of claim 17 wherein said alloy is die cast in said cavity.

21. The method of claim 18 wherein Ta is present in an amount from about 1 to about 2 atomic %.

22. An amorphous alloy represented by the atomic formula:

$$(Zr,Hf)_a(Al,Zn)_bTi_e,Nb_f,Ta_gY_h(Cu_xFe_y(Ni,Co)_z)_d$$

wherein a ranges from 45 to 65 atomic %, b ranges from 5 to 15 atomic %, e and f each is 1.5 atomic %, g is 1.5 atomic %, h ranges from 0 to 0.5 atomic %, and the balance is d and incidental impurities and wherein e+f+g is 4.5 atomic %, d times y is less than 10 atomic %, and x/z ranges from 0.5 to 2.

* * * * *